US006719101B2

(12) United States Patent
Hugel

(10) Patent No.: US 6,719,101 B2
(45) Date of Patent: Apr. 13, 2004

(54) SAFETY BRAKE WITH RETARDATION-DEPENDENT BRAKING FORCE

(75) Inventor: Stefan Hugel, Adligenswil (CH)

(73) Assignee: Inventio AG, Hergiswil (CH)

( * ) Notice: Subject to any disclaimer, the term of this patent is extended or adjusted under 35 U.S.C. 154(b) by 19 days.

(21) Appl. No.: 10/010,535

(22) Filed: Dec. 7, 2001

(65) Prior Publication Data

US 2002/0117357 A1 Aug. 29, 2002

(30) Foreign Application Priority Data

Dec. 8, 2000 (EP) ..... 00811166

(51) Int. Cl.[7] ..... B66B 5/22
(52) U.S. Cl. ..... 187/376; 187/372; 188/266.2
(58) Field of Search ..... 187/350, 351, 187/372, 376; 188/266.2, 266

(56) References Cited

U.S. PATENT DOCUMENTS 3,762,512 A 10/1973 McIntyre
5,096,020 A * 3/1992 Korhonen ..... 187/376
5,159,995 A * 11/1992 Sissala et al. ..... 187/376
5,363,942 A * 11/1994 Osada ..... 187/376
5,370,208 A * 12/1994 De Jong ..... 187/372
5,377,788 A 1/1995 Biewald et al.
5,648,644 A 7/1997 Nagel

FOREIGN PATENT DOCUMENTS

DE 39 34 492 4/1990

* cited by examiner

*Primary Examiner*—Dean J. Kramer
*Assistant Examiner*—Thuy V. Tran
(74) *Attorney, Agent, or Firm*—MacMillan, Sobanski & Todd, LLC

(57) ABSTRACT

A safety brake for braking a load receiving portion of an elevator has at least one brake wedge that penetrates a gap between a resiliently supported pressure body and a guide rail for the load receiving portion of the elevator and thereby generates a braking force. A stroke limiting device limits the penetration stroke of the brake wedge and controls the braking force in dependence on the retardation value of the load receiving portion of the elevator.

15 Claims, 3 Drawing Sheets

SAFETY BRAKE WITH RETARDATION-DEPENDENT BRAKING FORCE

BACKGROUND OF THE INVENTION

The present invention relates to a safety brake, with a retardation-dependent braking force, for a load receiving means of an elevator, which brake is triggered by an elevator speed limiter in the case of excess speed of the load receiving means, wherein at least one brake wedge penetrates into a tapering gap between a resiliently supported pressure body of the safety brake and a guide rail of the load receiving means and thereby generates a braking force and wherein the magnitude of this braking force is dependent on the retardation occurring at the load receiving means.

In the case of usual safety brakes a safety brake base body engages around the guide web of a guide rail of the load receiving means and includes at least one pressure body, which on the one hand forms, together with the guide web, a gap tapering in opposite direction to the direction of travel of the load receiving means and on the other hand is movable, counter to a spring element, perpendicularly to the guide web. In the case of excess speed of the load receiving means, a speed limiter mechanism displaces a brake wedge into the tapering gap between the pressure body and the guide web moving relative thereto, whereupon the brake wedge is drawn into the tapering gap by friction at the guide web up to an abutment at the base body and then slides along the guide web until standstill of the load receiving means. The pressure body is forced against the spring element by the wedge effect. The spring force resulting therefrom acts by way of the pressure body on the brake wedge and determines the perpendicular force arising between the brake wedge and the guide web and thus the arising frictional force acting as braking force at the load receiving means.

Such safety brakes have the disadvantage that the perpendicular force acting on the brake wedge is always of the same size independently of different useful loads in the load receiving means and other influences, such as, for example, the state and contamination of the brake surfaces, the instantaneous speed and the ambient temperature. This has the consequence that, in the case of braking, significantly different retardation values occur at the load receiving means. Since, for reasons for safety, a certain minimum retardation must be guaranteed, retardation values beyond the permissible limit value often result in the case of a minimum useful load.

There is known from the German patent document DE 39 34 492 a safety brake, which is fastened to load receiving means of an elevator, with a safety brake body constructed as a clasp with non-crossing clasp arms, in which on one side of the clasp joint the clasp arms embrace the guide web of a guide rail. One of these clasp arms at the guide rail side has a fixed friction element and the other is formed as a pressure body which, together with the guide web, forms a gap tapering in the opposite direction to the direction of travel of the load receiving means. A brake wedge is mounted between the pressure body and the guide web and does not contact the guide web in normal operation. On the other side of the clasp joint a biased spring element produces a spreading force on the clasp arms, which in normal operation act on an abutment limiting the opening width of the clasp arms.

In the case of excess speed of the load receiving means a speed limiter mechanism lifts the brake wedge, whereby this comes into contact with the guide web moving relative to the safety brake and is drawn by the web, through friction, into the tapering gap up to an abutment. The consequentially arising clamping force spreads the clasp arms at the side of the guide rail, whereby, on the other side of the clasp, the biased spring element is pressed. The biasing force of this spring element now presses the friction element by way of the clasp arms on the one hand and the pressure body and brake wedge on the other hand against the guide web, whereby a braking forces arises at the load receiving means.

In order to adapt the braking force, which is produced by this safety brake, to the respective conditions influencing the braking process, i.e. to always be able to achieve the same retardation at the load receiving means, the safety brake constructed as a clasp has at its clasp arms at the spring element side an electromagnet system which, in the case of a safety braking, counteracts the spring force of the spring element and thereby the perpendicular force acting on the brake wedge and thus reduces the braking force. The force effect of the lifting magnet system or the size of the braking force reduction is so regulated by a current regulator in dependence on the signal of a retardation measuring sensor that the load receiving means is always braked with the same retardation.

Such a safety brake has the disadvantage that it requires a large installation area, especially because the electromagnet system has to act on relatively long clasp arms in order to be able to influence the large braking perpendicular force in a sufficient range. Moreover, it requires a complicated electronic regulating device that imposes substantial demands with respect to functional reliability. In addition, an emergency current supply is necessary so that this remains functionally capable even in the event of a power failure.

The present invention has the object of proposing a safety brake which always brakes the load receiving means with the same retardation independently of different useful loads in the load receiving means and of other influences, such as, for example, the state and the contamination of the brake surfaces, the instantaneous speed and the ambient temperature.

SUMMARY OF THE INVENTION

The safety brake according to the present invention has significant advantages. It is based on safety brake technology known for a long time and needs little more installation space than a conventional construction. It does not require any electronic regulating device, which has to satisfy high demands in terms of technical reliability, and in the case of power failure is still functionally capable with only an emergency current supply. It is simple to understand, install and adjust. Vibration problems in consequence of regulating fluctuations cannot arise. A large number of existing conventional safety brakes can be retrofitted with components according to the present invention.

In an advantageous development of the device according to the present invention the speed at which the brake wedge penetrates into the tapering gap between pressure body and guide rail is limited during the entire penetration travel by a speed limiting device. It is thereby achieved that, in the case of safety braking, an abrupt build-up of the overall braking force and thus a correspondingly strong jolt on the load receiving means are avoided.

The stroke limiting device, which limits the penetration stroke of the brake wedge in dependence on the retardation of the load receiving means, preferably consists of a hydraulic system. Large forces, such as can occur in this connection, can be managed by hydraulic means on a smallest possible installation area.

In expedient manner the speed limiting device, which limits the penetration speed of the brake wedge, is also realized by hydraulic means. Such a solution is functionally reliable and adjustable in simple manner.

In a particularly simple embodiment of the invention the stroke limiting device for the brake wedge consists of a hydraulic cylinder with a piston rod, a hydraulic fluid container and a control valve arranged therebetween, wherein a retardation sensor so influences the control valve that this blocks the movement of the hydraulic cylinder and thus the further penetration of the brake wedge as soon as and for as long as the retardation of the load receiving means exceeds a specific value.

A further advantageous development of the invention consists in that the retardation sensor is a weight body which is movably connected with the load receiving means and the inertial force, which arises through the retardation of the load receiving means, of which influences the control valve by way of a lever system. The inertial force in that case usual acts against a spring, the spring constant of which is determined in dependence on the inertial force of the control valve stroke.

The weight body of the retardation sensor is preferably displaceably arranged on a first arm of a two-arm lever, so that there can be set at which retardation of the load receiving means the inertial force thereof has the effect of reversing the second lever arm of the control valve against the spring effect.

It is expedient to realize the speed limiting device for limitation of the penetration speed of the brake wedge in such a manner that an adjustable hydraulic flow valve limits the flow of the hydraulic fluid which flows from the hydraulic cylinder, which limits the penetration depth of the brake wedge, by way of the control valve to the hydraulic fluid container.

In a preferred embodiment the flow valve limiting the penetration speed of the brake wedge is constructed as an orifice valve or as an adjustable flow regulating valve. Orifice valves have a throttle effect virtually independent of temperature and viscosity of the hydraulic fluid. Flow regulating valves cause a constant throughflow independently of the prevailing pressure of the hydraulic fluid and thus guarantee a constant penetration speed of the brake wedge.

In a further embodiment of the invention the retardation sensor consists of a retardation sensor which is mounted at the load receiving means and in which, for example, a strain gauge force sensor detects the inertial force, which results from the retardation of the load receiving means, of a measuring body and influences an amplifier circuit which electromagnetically actuates the control valve.

A further advantageous development of the invention consists in that the hydraulic fluid container is constructed as a pressure storage device. In this manner the entire stroke and speed limiting system for the brake wedge is a closed hydraulic system standing under low excess pressure. Air inclusions, which are caused by vibrations, in the hydraulic fluid and the contamination thereof are thus excluded, which ensures a highest functional reliability of the system. Moreover, automatic resetting of the hydraulic cylinder after an instance of braking is effected by the mentioned excess pressure instead of by a compression spring.

In a preferred embodiment of the safety brake this comprises a single hydraulic block which contains all connecting ducts of the hydraulic system, wherein all other components of the hydraulic system are either integrated in this block or fastened thereto.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
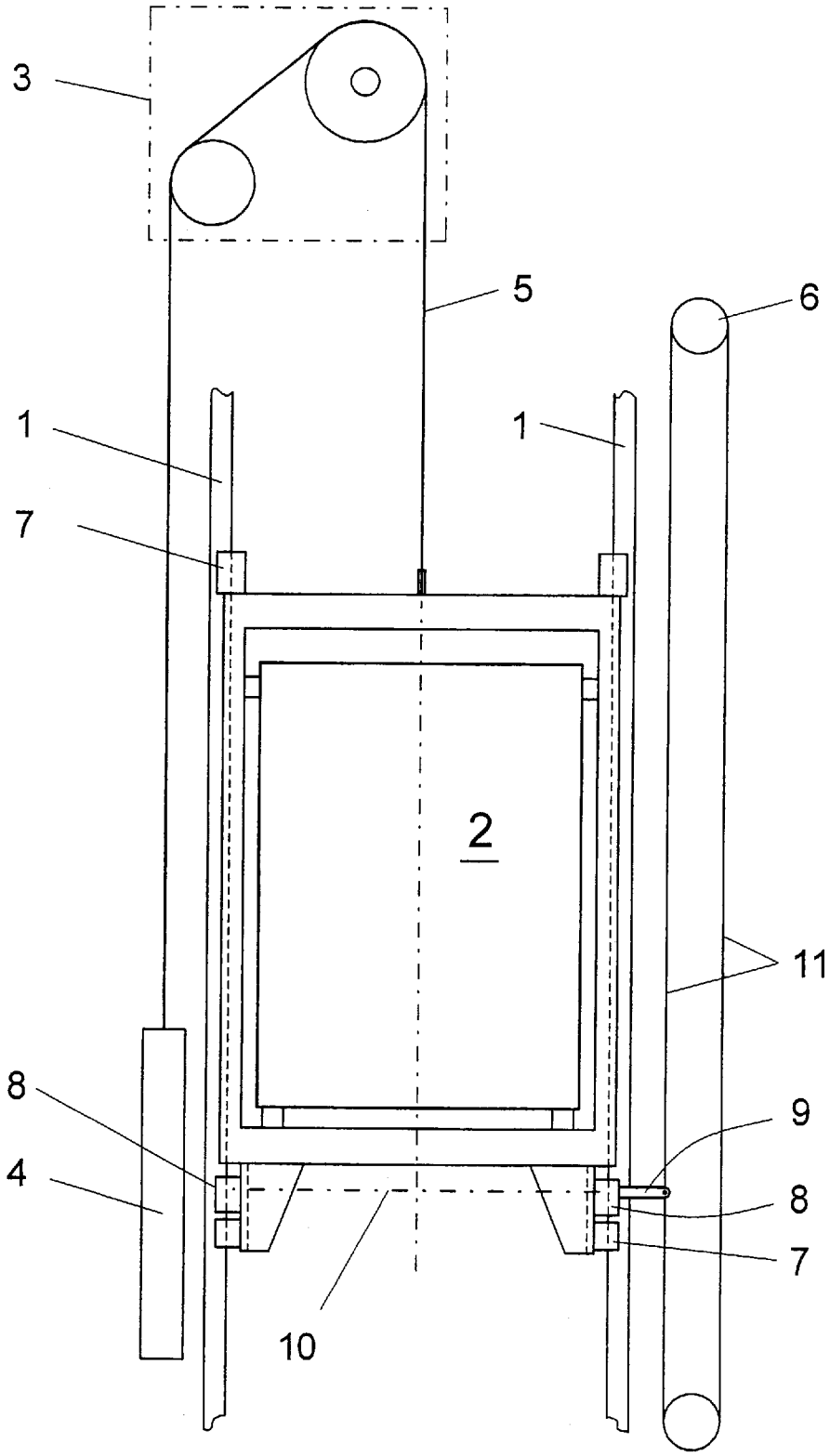
FIG. 1 is a schematic illustration of a safety brake according to the present invention in an elevator installation.

FIG. 1 shows an elevator installation with its major important components. Shown are a pair of guide rails 1, a load receiving means 2 guided by guide shoes 7 at the guide rails, a drive unit 3, a counterweight 4, support cables 5 connecting the load receiving means and the counterweight, an elevator speed limiter 6 with a limiter cable 11, and two safety brakes 8 according to the present invention with a trigger lever 9 and a trigger connecting element 10.

In the event of safety braking the elevator speed limiter 6 blocks the limiter cable 11, which triggers the two safety brakes 8 by way of the trigger lever 9 and the trigger connecting element 10, whereby the load receiving means 2 is braked.

Figure 2:
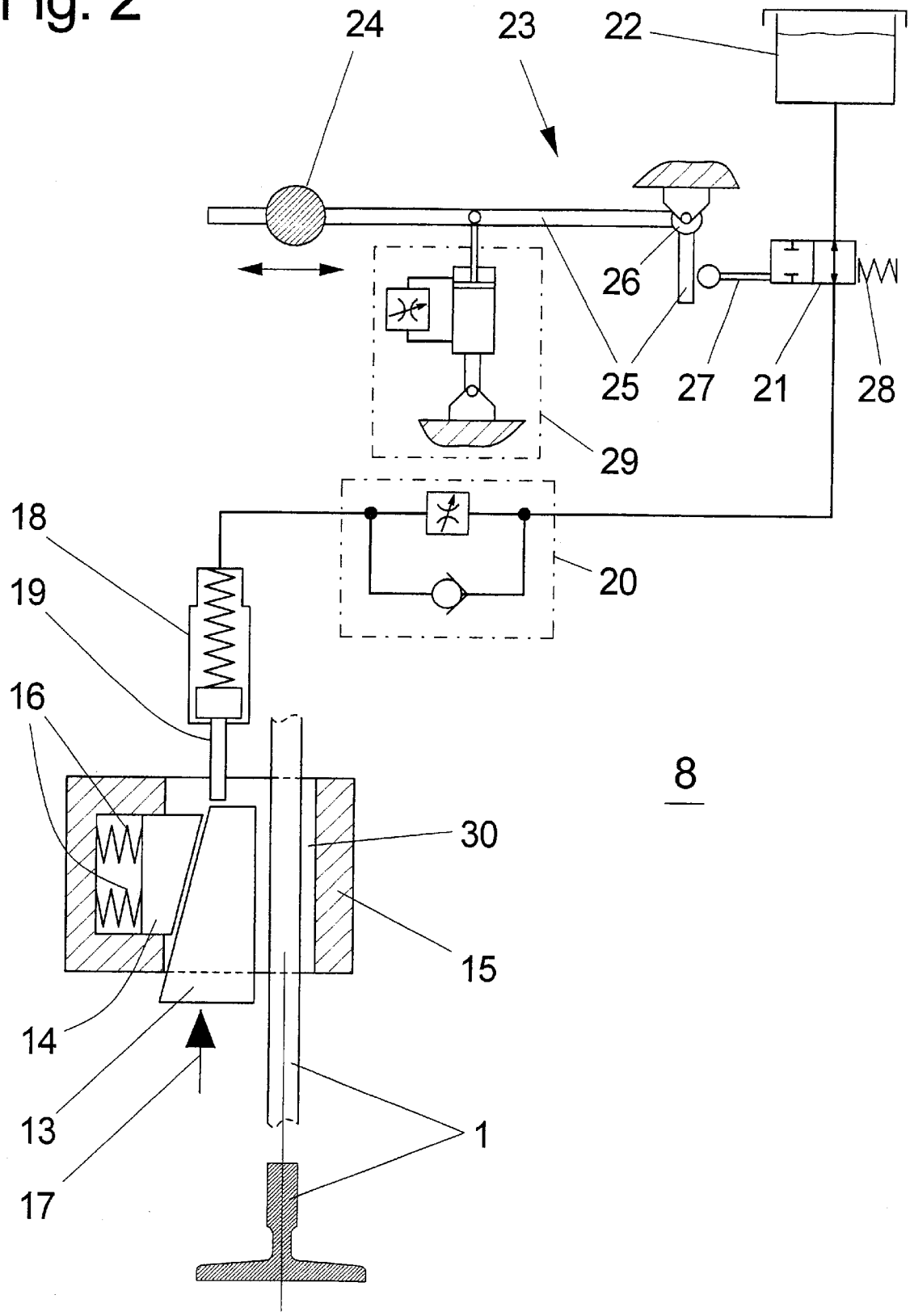
FIG. 2 is a schematic illustration of the safety brake according to the present invention with one brake wedge per guide rail and with an open hydraulic fluid container.

In FIG. 2 there is shown one of the safety brakes 8 according to the present invention, the safety brake having a housing 15 that surrounds the web of the guide rail 1 at a distance forming an air gap 30. The safety brake 8 further includes a brake wedge 13 that protrudes into the air gap 30 between a pressure body 14 and the web of the guide rail 1. The brake wedge 13 and the pressure body 14 have spaced apart facing complementary tapered surfaces. The pressure body 14 is supported relative to the housing 15 of the safety brake by way of spring elements 16. An arrow 17 is a symbol for a trigger mechanism, which is not illustrated in more detail here and which in the case of excess speed of the load receiving means 2 is activated by the elevator speed limiter 6 via the limiter cable 11 and the trigger lever 9 and introduces the brake wedge 13 further into the gap 30. The brake wedge 13 thereby goes into contact with the guide rail 1 moving relative to the safety brake and is drawn by the rail into the gap 30, since the contact surface between the brake wedge 13 and pressure body 14 is arranged to be particularly low in friction through coating or roller mounting.

Due to the wedge action, the brake wedge 13 forces the pressure body 14 against the spring elements 16, which thereby build up a pressure force. These elements 16 press the brake wedge 13 by way of the pressure body 14 against the guide rail 1, which in turn is pressed against the surrounding housing 15 of the safety brake 8. The thus-arising friction between the guide rail 1 and the brake wedge 13 as well as between the guide rail 1 and the housing 15 acts as a braking force on the load receiving means 2. The magnitude of this braking force is proportional to the depth of penetration of the brake wedge 13 into the gap 30, since the spring elements 16 are compressed in proportion to the depth of penetration. This depth of penetration is, in the case of a safety brake according to the present invention, determined by a variable abutment, which in accordance with the present invention is formed by a hydraulic cylinder 18 with a piston rod 19. The portion of the cylinder chamber opposite the piston rod 19 of the hydraulic cylinder 18 is connected by way of a flow valve 20 and a control valve 21 with a hydraulic fluid container 22, wherein these connections can be constructed as pressure-tight pipe ducts or as connections within a hydraulic block. The flow valve 20 is constructed as an orifice valve or as a flow regulating valve with a non-return valve and has the task of so influencing the outflow of the hydraulic fluid from the hydraulic cylinder 18 that the brake wedge 13 in the case of braking is drawn into the tapering gap at controlled speed, so that the jolt occurring at the load receiving means 2 at the start of braking is reduced. A construction of the flow valve 20 as a flow regulating valve has the advantage that the throughflow of the hydraulic medium is kept constant independently of the pressure ratios. The control valve 21 has the task, when actuated, of interrupting the outflow of the hydraulic fluid from the hydraulic cylinder 18, wherein the actuation takes place by way of a retardation sensor 23. The sensor include a weight body 24 mounted to be displaceable on the horizontal limb of a pivotably mounted bellcrank 25, wherein a mounting 26 thereof stands in mechanical connection with the load receiving means 2.

On retardation of the load receiving means 2 from downward travel the inertial force of the weight body 24 in the bellcrank 25 causes a moment, which is proportional to the retardation, about the mounting 26 thereof. The other limb of the bellcrank 25 acts with a corresponding force on an actuating element 27 of the control valve 21, wherein it has to overcome the counter force of a spring 28 which seeks to keep the actuating element 27 in the position corresponding to the throughflow setting of the control valve 21. The displaceability of the weight body 24 on the bellcrank 25 makes it possible to adjust the switching point of the control valve 21 to different retardation values. In order to avoid vibration problems during a braking process, the movement of the bellcrank 25 is damped by an adjustable hydraulic damping element 29.

Safety braking with the safety brake according to the invention takes place as follows:

The trigger mechanism (arrow 17) lifts the brake wedge 13 until this is clamped in place in the tapering gap between the pressure body 14 and the guide rail 1. Due to the constructional measures explained in the foregoing the friction between the brake wedge 13 and the guide rail 1 is higher than between the brake wedge 13 and the pressure body 14, which has the consequence that the guide rail 1 moving relative to the safety brake draws the brake wedge 13 into the gap 30, wherein the brake wedge 13 simultaneously moves the piston rod 19 of the hydraulic cylinder 18 upwardly and in that case the hydraulic fluid disposed in the hydraulic cylinder 18 is displaced via the flow valve 20 and the open control valve 21 to the hydraulic fluid container 22. The flow valve 20 in that case causes a controlled speed of penetration of the brake wedge 13.

As described in the foregoing, in this process there arises a depth of penetration of the brake wedge 13 proportional to the braking force acting on the load receiving means 2. If during penetration of the brake wedge 13 the retardation of the load receiving means 2 reaches a defined value, the retardation sensor 23 set to this value then reacts in that the inertial force of the weight body 24 brings, by way of the bellcrank 25 and against the spring 28, the control valve 21 into the blocked state. A further penetration of the brake wedge 13 and an undesirably high retardation of the load receiving means 2 are thereby prevented. If the retardation of the load receiving means 2 during the braking process falls below the set value, then the retardation sensor 23 would again release throughflow through the control valve 21 and enable a deeper penetration of the brake wedge 13 until the set retardation value was achieved again. For resetting of the safety brake into the initial state after safety braking, the load receiving means 2 is moved oppositely to the braking direction. The brake wedges 13 in that case move out of the gap 30 and the hydraulic cylinder 18 is brought by a resetting spring into its initial position, wherein the hydraulic fluid flows back out of the hydraulic fluid container 22, which is disposed higher, by way of the control valve 21 and the non-return portion of the flow valve 20 and refills the corresponding piston chamber.

Figure 3:
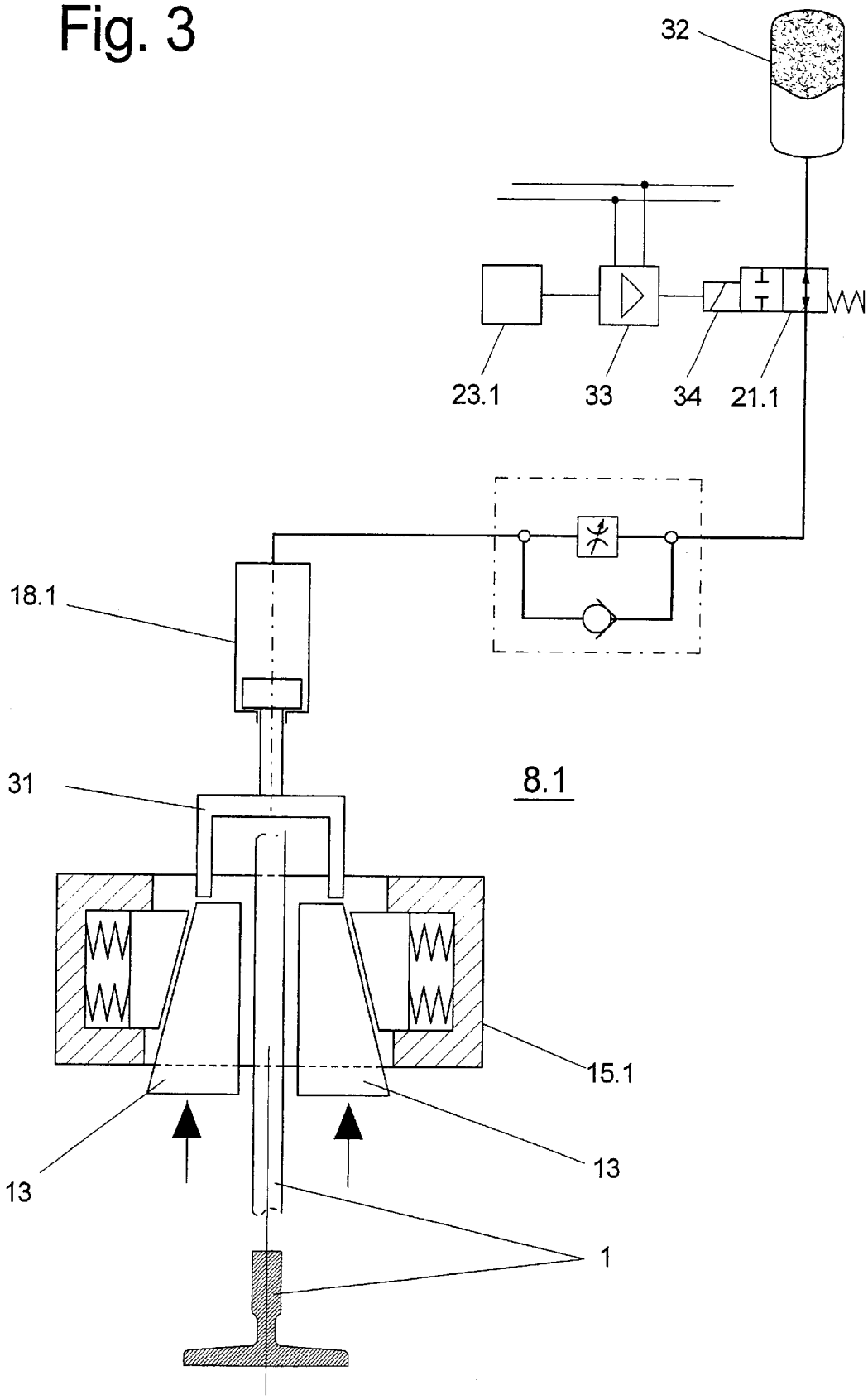
FIG. 3 is a schematic illustration of an alternate embodiment of the safety brake with two brake wedges per guide rail, with a pressure storage device as hydraulic fluid container and with an electrical drive control of the control valve.

FIG. 3 shows a variant safety brake 8.1 according to the present invention with two of the brake wedges 13. This variant has the advantage relative to the safety brake 8 according to FIG. 2 in that a housing 15.1 does not, in the case of braking, have to execute a transverse movement for equalization of the air gap 30 (FIG. 2), which is required in operation, between the housing 15 (FIG. 2) and the guide rail 1. A hydraulic cylinder 18.1 controlling the penetration speed of the brake wedges 13 here acts synchronously on the two brake wedges 13 by way of a bridge element 31.

In FIG. 3 the hydraulic fluid container 22 (FIG. 2) of the embodiment according to FIG. 2 is replaced by a pressure storage device 32, whereby the hydraulic system is completely closed relative to the environment and is protected against air ingress and contamination. The pressure storage device 32, which generates a low excess pressure, also looks after resetting of the hydraulic cylinder 18.1 after a safety braking.

An electromagnetic variant for drive control of a control valve 21.1 is similarly illustrated in FIG. 3. It comprises a retardation sensor 23.1, which has, as an integrated unit, a force measuring device on the basis of strain gauges, which device detects the inertial force of a weight body and generates an electrical signal to an amplifying and switching unit 33, which in turn acts on an actuating electromagnet 34 of the control valve 21.1.

The essential functions and effects of this variant safety brake 8.1 correspond with those of the variant safety brake 8 according to FIG. 2.

With analogous adaptation the safety brake (8, 8.1) according to the present invention can obviously also be used as safety brake means for securing the load receiving means 2 against excess speed in an upward direction.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety brake, generating a retardation-dependent braking force, for braking a load receiving means of an elevator, which safety brake is triggered by an elevator speed limiter in the case of excess speed of the load receiving means, comprising: a housing having a gap formed therein for receiving a guide rail, at least one brake wedge movable in said gap, a pressure body resiliently supported in said housing, and a stroke limiting device coupled to said at least one brake wedge wherein when said housing is attached to the load receiving means and receives an associated guide rail in said gap and when the elevator speed limiter moves said at least one brake wedge into contact with said pressure body and the guide rail to generate a braking force on the load receiving means, said stroke limiting device limits a penetration stroke of said at least one brake wedge in said gap in dependence on a retardation value of the load receiving means thereby controlling said braking force.

2. The safety brake according to claim 1 including a speed limiting device connected to said stroke limiting device to adjustably determine a speed of said at least one brake wedge during said penetration stroke thereof.

3. The safety brake according to claim 2 wherein said speed limiting device is a hydraulic system.

4. The safety brake according to claim 3 wherein said speed limiting device includes a flow valve connected in said hydraulic system.

5. The safety brake according to claim 1 wherein said stroke limiting device is a hydraulic system connected to a retardation sensor sensing the retardation value of the load receiving means.

6. The safety brake according to claim 5 wherein said hydraulic system includes a hydraulic fluid container, a hydraulic cylinder having a piston rod coupled to said at least one brake wedge, and a control valve connected between said container and said cylinder, said control valve being responsive to said retardation sensor which as soon as and for as long as a predetermined retardation value of the load receiving means is exceeded operates said control valve to block flow of hydraulic fluid between said container and said cylinder and thus prevents further penetration of said at least one brake wedge in said gap.

7. The safety brake according to claim 6 wherein said retardation sensor includes a weight body adapted to be movably connected with the load receiving means and which operates said control valve by a lever system.

8. The safety brake according to claim 7 wherein said weight body is displaceably arranged on a first lever arm of a two-arm lever forming said lever system.

9. The safety brake according to claim 6 including an adjustable flow valve connected between said cylinder and said container for limiting a flow of hydraulic fluid from said cylinder to said container through said control valve to adjustably determine a speed of said at least one brake wedge during said penetration stroke thereof.

10. The safety brake according to claim 9 wherein said adjustable flow valve is one of an orifice valve and a flow regulating valve.

11. The safety brake according to claim 6 wherein said retardation sensor is an electromagnetic device that detects an inertial force occurring due to retardation and actuates said control valve by means of an electromagnet via an electronic amplifying circuit.

12. The safety brake according to claim 6 wherein said container is a pressure storage device.

13. A safety brake, generating a retardation-dependent braking force, for braking a load receiving means of an elevator, which safety brake is triggered by an elevator speed limiter in the case of excess speed of the lead receiving means, comprising: a housing having a gap formed therein for receiving a guide rail, a pair of brake wedges movable in said gap, a pair of pressure bodies resiliently supported in said housing, and a stroke limiting device coupled to said brake wedges wherein when said housing is attached to the load receiving means and receives an associated guide rail in said gap between said brake wedges and when the elevator speed limiter moves said brake wedges into contact with said pressure bodies and the guide rail to generate a braking force on the load receiving means, said stroke limiting device limits a penetration stroke of each of said brake wedges in said gap in dependence on a retardation value of the load receiving means thereby controlling said braking force.

14. The safety brake according to claim 13 wherein said stroke limiting device includes a bridge element coupling said brake wedges for synchronizing said penetration strokes.

15. A safety brake, generating a retardation-dependent braking force, for braking a load receiving means of an elevator, which safety brake is triggered by an elevator speed limiter in the case of excess speed of the load receiving means, comprising:

a housing having a gap formed therein for receiving a guide rail;

at least a pair of brake wedges movable in said gap;

a pressure body resiliently supported in said housing;

a stroke limiting hydraulic system coupled to said at least one brake wedge; and a retardation sensor sensing the retardation value of the load receiving means, said stroke limiting hydraulic system being connected to said retardation sensor wherein when said housing is attached to the load receiving means and receives an associated guide rail in said gap and when the elevator speed limiter moves said at least one brake wedge into contact with said pressure body and the guide rail to generate a braking force on the load receiving means, said stroke limiting device limits a penetration stroke of said at least one brake wedge in said gap in dependence on a retardation value of the load receiving means thereby controlling said braking force.

* * * * *